US008517748B1

(12) United States Patent
Kelsch et al.

(10) Patent No.: US 8,517,748 B1
(45) Date of Patent: Aug. 27, 2013

(54) COMMUNICATION CONNECTOR WITH ANALOG COUPLING CIRCUIT

(71) Applicants: Vanguard Protex Global, Inc., Orlando, FL (US); Christopher A. Kelsch, Tarpon Springs, FL (US); Chung-Ping Lee, Taoyuan (TW)

(72) Inventors: Christopher A. Kelsch, Tarpon Springs, FL (US); Chung-Ping Lee, Taoyuan (TW); John N. Figh, Jr., Oldsmar, FL (US); Lucas P. Swartwood, Tampa, FL (US); Bruno M. L. Telles, Tampa, FL (US)

(73) Assignee: Vanguard Products Group, Inc., Oldsmar, FL (US)

( * ) Notice: Subject to any disclaimer, the term of this patent is extended or adjusted under 35 U.S.C. 154(b) by 0 days.

(21) Appl. No.: 13/758,174

(22) Filed: Feb. 4, 2013

Related U.S. Application Data

(60) Provisional application No. 61/674,629, filed on Jul. 23, 2012.

(51) Int. Cl.
*H01R 29/00* (2006.01)
*H01H 1/58* (2006.01)

(52) U.S. Cl.
USPC ..... 439/188; 439/607.55; 439/607.41; 200/51.09

(58) Field of Classification Search
USPC 439/660, 188, 607.27, 607.34, 607.41–607.45, 439/607.54, 607.55, 98, 373; 200/51 R, 200/51.09, 51.1
See application file for complete search history.

(56) References Cited

U.S. PATENT DOCUMENTS

| | | | | |
|---|---|---|---|---|
| 3,423,747 | A | 1/1969 | Hogencamp | |
| 4,075,617 | A | 2/1978 | Wireman | |
| 4,234,879 | A | 11/1980 | Baker | |
| 4,300,130 | A | 11/1981 | Fotheringham et al. | |
| 5,059,948 | A | 10/1991 | Desmeules | |
| 5,142,269 | A | 8/1992 | Mueller | |
| 5,191,314 | A | 3/1993 | Ackerman et al. | |
| 5,572,186 | A | 11/1996 | Traxler et al. | |
| 5,681,172 | A * | 10/1997 | Moldenhauer | 439/98 |
| 5,977,877 | A | 11/1999 | McCulloch et al. | |
| 6,147,603 | A | 11/2000 | Rand | |

(Continued)

FOREIGN PATENT DOCUMENTS

| | | |
|---|---|---|
| CN | 201369458 | 12/2009 |
| GB | 2187017 | 8/1987 |
| GB | 2282923 | 4/1995 |

*Primary Examiner* — Felix O Figueroa
(74) *Attorney, Agent, or Firm* — Andriy Lytvyn; David Jacobs; Smith & Hopen, P.A.

(57) ABSTRACT

A communication connector with analog coupling circuit and a mechanical coupling circuit used for providing security to electronic devices. The analog circuit includes a male plug with an outer shell and tongue shell. Between the outer shell and tongue is a thin layer of non-conductive material to prevent the closure of a circuit. Two separate conductors are wired through the USB body; one attaching to the outer shell and the other attaching to the tongue. A closed circuit is created when the male USB is placed into a female receptor. The mechanical circuit creates a closed circuit when the plunger switch becomes compressed. There is a security monitor system connected to an end of the two conductors, which sound an alarm when circuit is opened. The alarm will sound if a thief attempts to steal the article either by cutting the wire or removal of the plug.

8 Claims, 6 Drawing Sheets

(56) References Cited

U.S. PATENT DOCUMENTS

| | | | | |
|---|---|---|---|---|
| 6,150,940 | A | 11/2000 | Chapman, Jr. et al. | |
| 6,215,400 | B1 | 4/2001 | Rand et al. | |
| 6,462,668 | B1 | 10/2002 | Foseide | |
| 6,761,579 | B2 | 7/2004 | Fort, Jr. et al. | |
| 6,861,953 | B2 | 3/2005 | Deconinck et al. | |
| 6,896,543 | B2 | 5/2005 | Fort, Jr. et al. | |
| 6,979,223 | B2 * | 12/2005 | Chen | 439/490 |
| 7,015,596 | B2 | 3/2006 | Pail | |
| 7,053,774 | B2 | 5/2006 | Sedon et al. | |
| 7,305,714 | B2 | 12/2007 | Hamaguchi et al. | |
| 7,385,522 | B2 | 6/2008 | Belden et al. | |
| 7,410,370 | B2 * | 8/2008 | Sprouse et al. | 439/95 |
| 7,446,659 | B2 | 11/2008 | Marsilio et al. | |
| 7,474,209 | B2 | 1/2009 | Marsilio et al. | |
| 7,629,895 | B2 | 12/2009 | Belden, Jr. et al. | |
| 7,710,266 | B2 | 5/2010 | Belden, Jr. et al. | |
| 7,845,965 | B2 * | 12/2010 | Ko | 439/607.55 |
| 7,909,637 | B2 | 3/2011 | Montena | |
| 7,927,126 | B1 * | 4/2011 | Bender | 439/369 |
| 7,986,225 | B1 | 7/2011 | Edelstein et al. | |
| 2005/0174238 | A1 | 8/2005 | Foseide | |
| 2009/0189765 | A1 | 7/2009 | Lev et al. | |
| 2010/0315752 | A1 * | 12/2010 | Rabu et al. | 439/620.01 |
| 2011/0143594 | A1 * | 6/2011 | Nagata | 439/607.54 |
| 2012/0182146 | A1 | 7/2012 | Berglund et al. | |

* cited by examiner

COMMUNICATION CONNECTOR WITH ANALOG COUPLING CIRCUIT

CROSS-REFERENCE TO RELATED APPLICATIONS

This non-provisional application is a continuation of and claims priority to provisional application No. 61/674,629 entitled "COMMUNICATION CONNECTOR WITH ANALOG COUPLING CIRCUIT," filed Jul. 23, 2012.

BACKGROUND OF THE INVENTION

1. Field of the Invention

This invention relates to electronic device security through an analog electrical circuit. More specifically, it relates to an alarm system created through a closed circuit in the single point of entry for an electronic charging plug, such as a micro USB (Universal Serial Bus).

2. Brief Description of the Related Art

Currently, electronic devices are secured in stores through various locking mechanisms. Some of these mechanisms are equipped with an alarm to warn when the device is unplugged. Many of the devices meant to protect against theft of the electronic device impede the consumer from fully accessing and utilizing the device. One of the most common examples of security devices impeding the accessibility of an electronic device is in the retail of cellular phones.

Cellular phones are secured through a device that substantially blocks the back-side of the phone in many retail locations. This poses a problem with the evolution of technology. As the cell phones evolve, their uses evolve. One of the latest innovations is near field communication between cellular phones. Near field communication establishes radio communication between two cellular phones through touch or close proximity. This technology has many different applications that include contactless transactions, data exchange, and simplified setup of more complex communications.

The most common method of creating near field communication is for the back of two cellular phones to come into physical contact with each other. This creates a problem in retail stores that want to show the technology of the phone, but are prevented from doing so because of a security device attached to the back of the cellular phone. Presently, there is a lack of security devices that will alarm against potential theft while leaving the back of the cellular phone substantially free.

Additionally, many security devices in the prior art substitute aesthetics for security of the electronic device. The large, clunky security devices attached to the back of many cellular phones add weight and a clunky feel to the electronic device. There exists a need for a simplified electronic protection device that provides a cost effective security solution while properly displaying the electronic device as intended.

Thus, in view of the art considered as a whole at the time the present invention was made, it was not obvious to those of ordinary skill in the field of this invention how the shortcomings of the prior art could be overcome.

BRIEF SUMMARY OF THE INVENTION

The long-standing but heretofore unfulfilled need for an alarm system created through a closed circuit in the single point of entry for an electronic charging plug, such as a micro USB, that provides economical security to electronic devices while preserving the aesthetics of the electronic device, is now met by a new, useful, and nonobvious invention.

The novel structure of the alarm system includes a male USB having a first shell that includes non-conductive material. In a preferred embodiment, the non-conductive material is plastic. Inherent in the design of a male USB is a contact end, adapted to engage a corresponding female receptor, and a base end that substantially remains un-contacted with female receptor. A second shell communicates with the first shell along the contact end of the male USB with a portion extending onto the base end. A first solder point is located on the portion of said second shell extending onto said base end wherein a first conductor wire attaches. The second shell forms a U-shape along the top side of male USB contact end. A third shell contacts the first shell, but is not in physical contact with said second shell. The third shell includes a tongue portion and a mouth portion. Mouth portion is located on the base end of the male USB. Tongue portion extends longitudinally from the mouth portion into the contact end. In a preferred embodiment, tongue extends into the open area formed by the U-shape of second shell along the top portion of male USB contact end. A second conductor wire connects to a second solder point on the third shell. Second and third shells should include conductive material. In a preferred embodiment the conductive material is metal.

The novel invention may further include a shroud device used to secure the male USB to an electronic device. Shroud comprises a first arm and a second arm being disposed in perpendicular relation to one another connected by an elbow joint. First arm includes an adhesive side and a base side. Adhesive side of the first arm includes a mechanism for attaching firm arm to an electronic device. A gap is formed within the second arm and first arm extending through the elbow joint. Gap allows for a male USB to engage the device without being removed when the male USB is in a horizontal orientation.

BRIEF DESCRIPTION OF THE DRAWINGS

For a fuller understanding of the invention, reference should be made to the following detailed description, taken in connection with the accompanying drawings, in which.

DETAILED DESCRIPTION OF THE PREFERRED EMBODIMENT

In the following detailed description of the preferred embodiment, reference is made to the accompanying drawings, which form a part hereof, and within which are shown by way of illustration specific embodiments by which the invention may be practiced. It is to be understood that other embodiments may be utilized and structural changes may be made without departing from the scope of the invention.

As used in this specification and the appended claims, the singular forms "a", "an", and "the" include plural referents unless the content clearly dictates otherwise. As used in this specification and the appended claims, the term "or" is generally employed in its sense including "and/or" unless the context clearly dictates otherwise.

Figure 1:
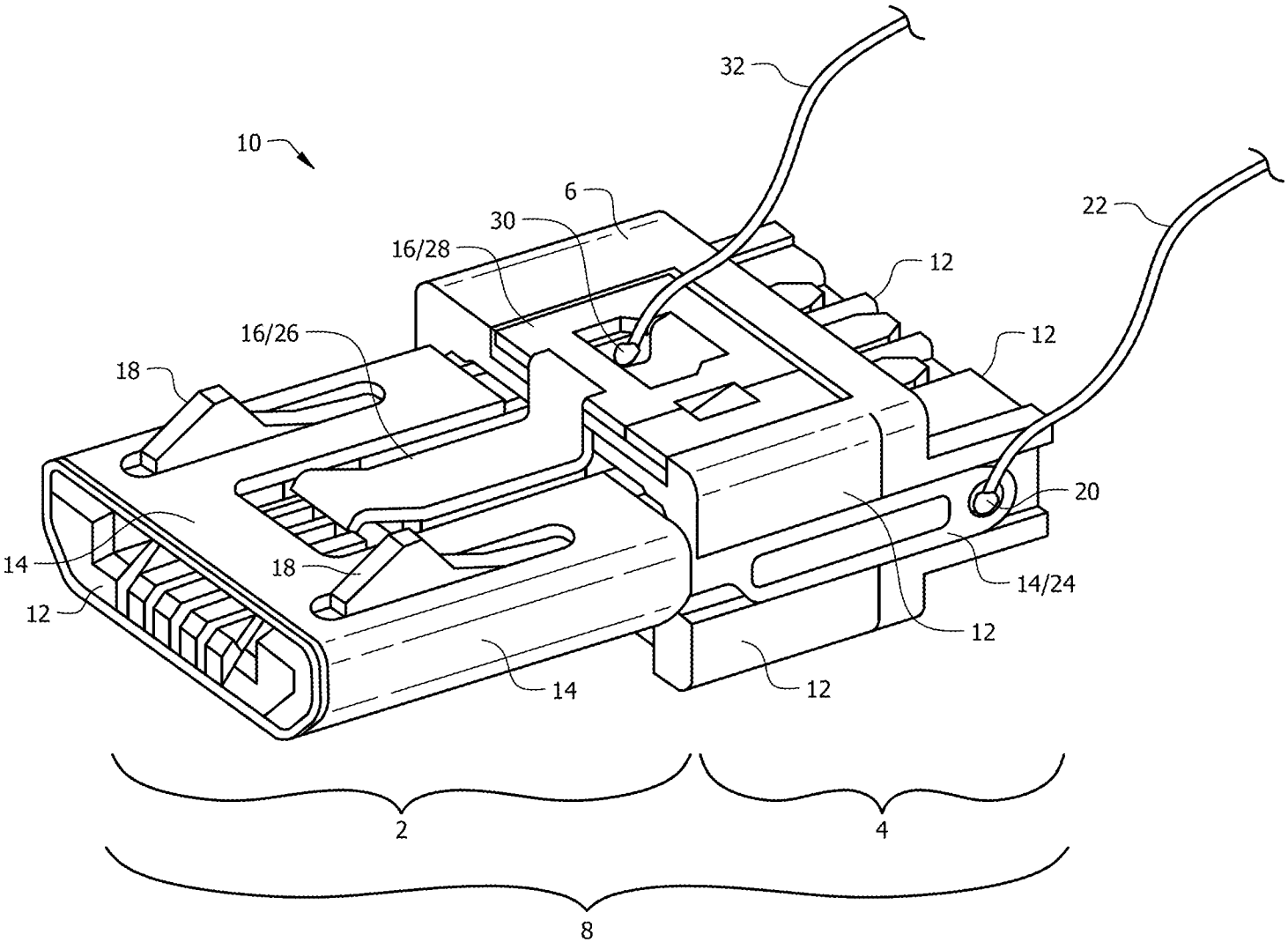
FIG. 1 is a male USB illustration of a preferred embodiment of the present invention.

The novel structure is denoted as a whole in FIG. 1 by the reference numeral 10. FIG. 1 depicts a view of a male USB connection portion in accordance with a preferred embodiment of the present invention. A first shell 12 substantially forms a traditional male USB housing, which includes a contact end 2 and a base end 4. Contact end 2 is placed into contact with a female receptor with base end 4 substantially not in contact. A second shell 14 and a third shell 16 are placed into contact with first shell 12, such that second shell 14 and third shell 16 are not in contact with each other, as shown in FIG. 1. It is foreseeable that male USB 10 be comprised mostly of second shell 14 and third shell 16 with first shell 12 merely serving as an insulator or separator between second 14 and third 16 shells.

Second shell 14 substantially surrounds contact end 2 of male USB 10, as illustrated in FIG. 1. In an alternative embodiment, second shell may only be a small portion of contact end 2. Inherent in the design of a male USB is a top portion 6 and a bottom portion 8. Second shell 14 has a rectangular section that does not cover contact end 2 along top portion 6 of male USB 10. This rectangular section results in a U-shape design of second shell 14 along top portion 6 of male USB 10. In a preferred embodiment, second shell 14 contains two additional open sections to accommodate locking arms 18 found in some micro USBs, as shown. Second shell 14 includes a solder point 20 where a first switch conductor wire 22 contacts second shell 14. In a preferred embodiment, second shell 14 has at least one extending wing portion 24 that contacts first shell 12 along the side of the male USB 10. Wing portion 24 extends into base end 4 of male USB 10. This allows contact end 2 of male USB 10 to be free of any obstructions, i.e. first switch conductor wire 22.

Third shell 16 includes a tongue 26 and a conductor base 28. Conductor base is located along top portion 6 of base end 4 on male USB 10. In a preferred embodiment, a second solder point 30 for contacting a second switch conductor 32 to third shell 16 is located on conductor base 28. Tongue 26 extends from conductor base 28 to the open U-shape portion of second shell 14 extending into contact end 2, as shown. Tongue 16 extends slightly upwards from base end 2 at a predetermined angle. In a preferred embodiment, tongue 26 extends slightly upwards from base end for a predetermined length at a predetermined angle and extends at a steeper angle at end of the tongue 26 before creating a hook at the end. This embodiment of tongue 26 is illustrated in FIGS. 1 and 2.

First shell 12 is placed between tongue 26 and second shell 14. In an alternative embodiment, tongue 26 hangs freely without contacting first 12 or second 14 shells. Second 14 and third 16 shells must not be in physical contact with one another, preferably separated by first shell 12. In a preferred embodiment, first shell 12 is comprised of non-conductive material, such as plastic. Second 14 and third 16 shells are preferably made of conductive material, such as metal. A first switch conductor wire 22 is wired to second shell 14 solder point 20. A second switch conductor wire 32 is wired to second solder point 30 on third shell 16. Thus, an incomplete circuit is formed between second shell 14 and third shell 16 of male USB 10 when the first switch conductor wire 22 and second switch conductor wire 32 are plugged in.

Figure 2A:
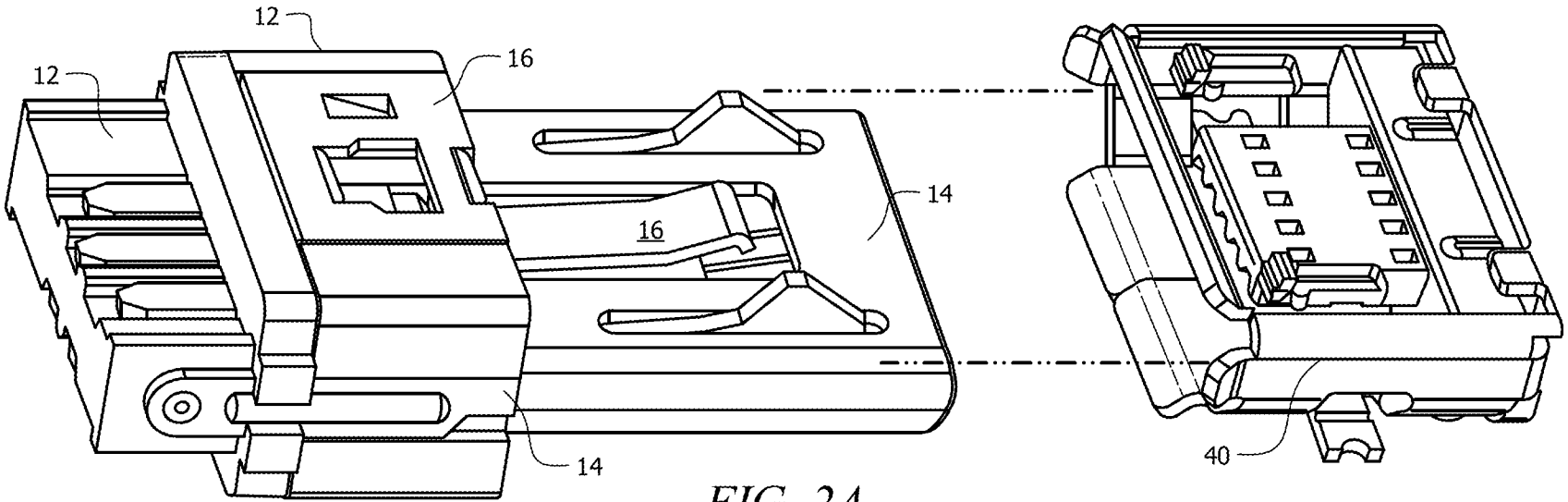
FIG. 2A is an illustration of a male USB in accordance with a preferred embodiment of the present invention and a corresponding female receptacle.
Figure 2B:
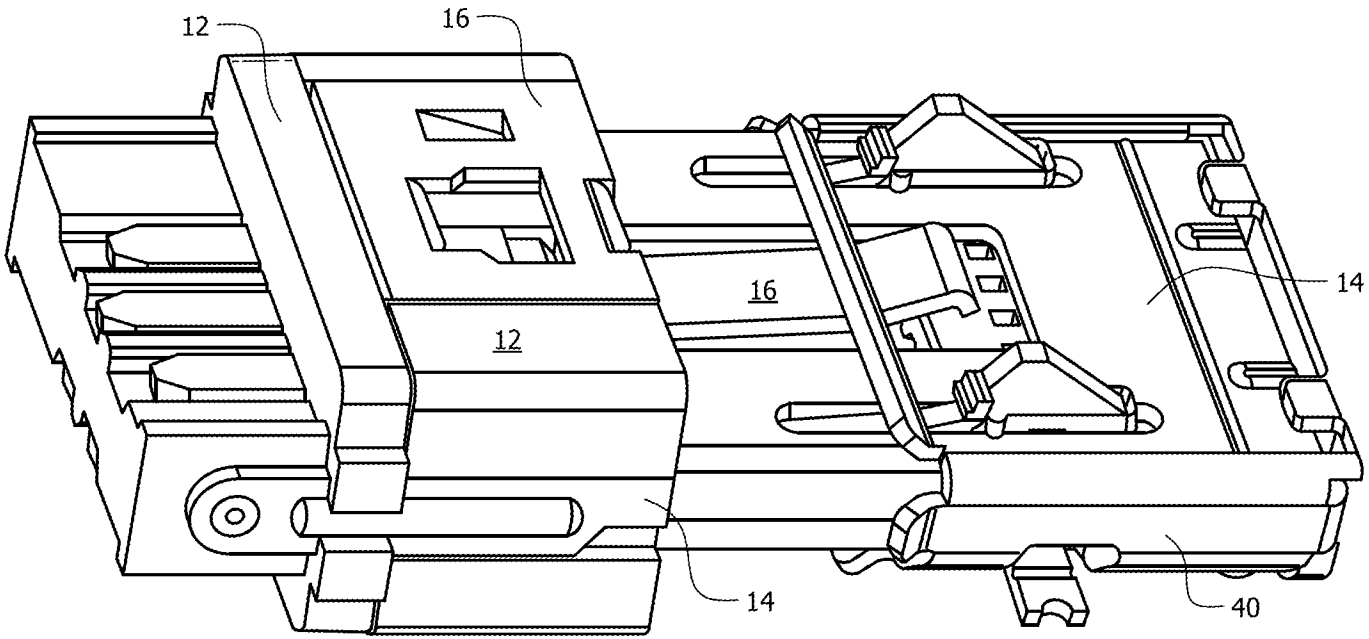
FIG. 2B is an illustration of a male USB in accordance with a preferred embodiment of the present invention engaged with a corresponding female receptacle.

FIGS. 2A and 2B illustrate male USB 10 interacting with a corresponding female receptor 40 in accordance with a preferred embodiment of the present invention. Female receptor 40 fittings on electronic devices, including cellular phones, are comprised of one continuously conductive metal piece. When male USB 10 in accordance with the present invention mates with corresponding female receptor 40, the second 14 and third 16 shells of male USB 10 come into contact with female receptor's 40 metal housing as shown in FIG. 2B. When second 14 and third 16 housing comes into contact with female receptor 40 a closed circuit is created between first switch conductor wire 22 and second switch conductor wire 32. Conductor wires are attached to an external alarm system that detects when a circuit is created between first switch conductor wire 22 and second switch conductor wire 32. The creation of the closed circuit arms the alarm system. An alarm is activated when the closed circuit between the two conductors is broken or no longer exists, e.g. the male USB 10 is removed from the female receptor 40 without authorization. It is foreseeable that the female receptor 40 only contain a single conductive piece that contacts second shell 14 and third shell 16. The conductive piece establishes the closed circuit between second shell 14 and third shell 16.

Figure 3:
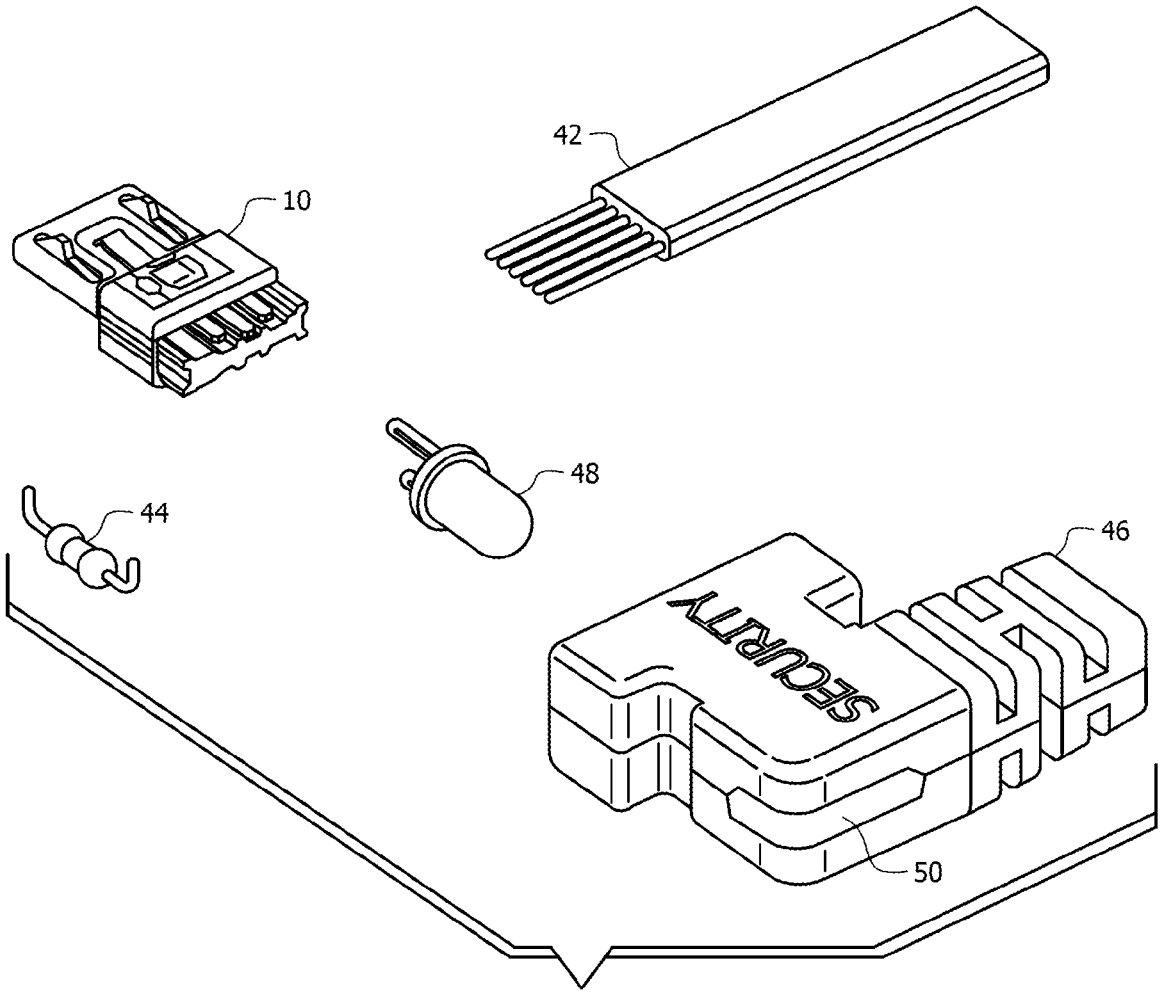
FIG. 3 is an illustration of an exploded view of a male USB in accordance with a preferred embodiment of the present invention.

FIG. 3 illustrates the wiring of a male USB for use in charging an electronic device in accordance with a preferred embodiment of the present invention. A cable 42 connects a Resistor 44 and male USB 10 as shown. LED can be powered by a separate circuit driven by an alarm module. LED light receives a signal from alarm module when second 14 and third 16 shells have created a closed circuit through contact with female receptor 40. When the closed circuit is broken the LED light turns on to indicate that the circuit has been disconnected. Alternatively, the LED light may turn off once the circuit is destroyed. In an alternative embodiment, an LED light 48 is connected to the cable to provide an indication of whether power is flowing through the male USB 10. An overmold 46 is placed over the wiring, such that the contact end 2 of male USB 10 is the only exposed portion. An LED lens 50 is provided on overmold 46, as shown, so that LED light 48 may be easily seen. In a preferred embodiment, overmold 46 should contain two wing portions that extend outwards and an indented portion immediately following the two wing portions as illustrated in FIG. 3

The USB connecter may be standard, mini or micro type A or B USB connectors. In a preferred embodiment, the USB connector is a micro-USB connector type. A micro-USB is preferred because the Open Mobile Terminal Platform (OMTP) endorsed micro-USB as the standard connector for data and power on mobile devices.

Figure 5:
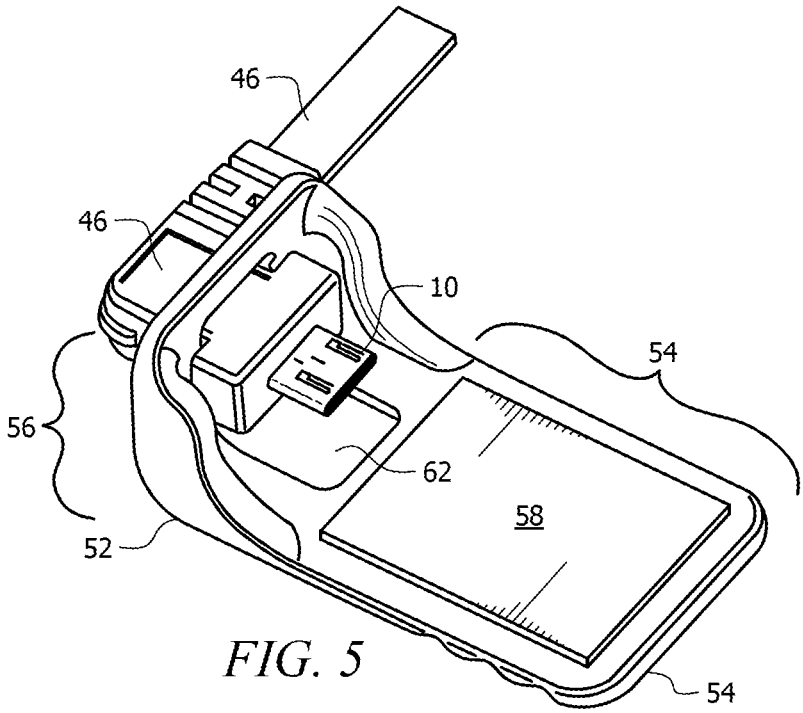
FIG. 5 is an illustration of a locking mechanism in accordance with a preferred embodiment of the present invention.

It is foreseeable that false alarms may be caused by constant plugging in and removal of the present invention. This potential issue is addressed through the addition of a shroud 52 as illustrated in FIG. 5. Shroud 52 is curved in the shape of an elbow joint with a first arm 54 and a second arm 56 each extending perpendicular from one another along the elbow joint. First arm 54 includes an adhesive side 58 and a supporting side 60. Adhesive side 58 should include an attachment mechanism for attaching shroud 52 to an electronic device. In a preferred embodiment, the attachment mechanism is double-sided adhesive such as that known in the art at the time of the invention.

Figure 6:
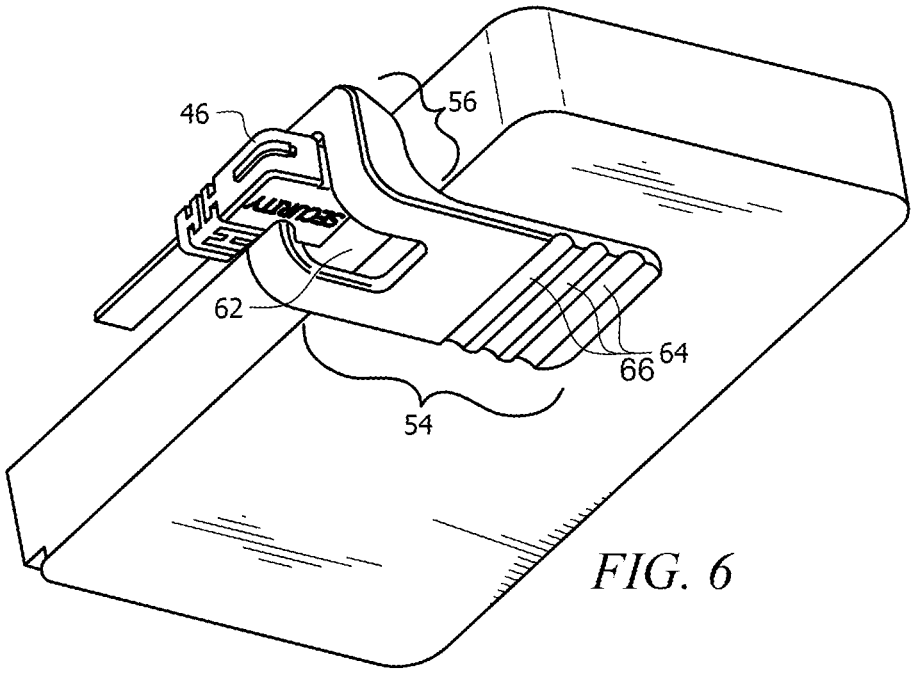
FIG. 6 is an illustration of a locking mechanism engaged with a mobile electronic device in accordance with a preferred embodiment of the present invention.

Second arm 56 is perpendicular to first arm 54 extending in one direction from the elbow joint. A gap 62 is located within second arm 56 extending into first arm 54 as shown in FIGS. 5 and 6. Width of Gap 62 should be less than overmold 46 or casing of male USB 10. Gap 62 length should be at least the size of the male USB overmold 46 or casing and at least a portion of the length should extend into first arm 54. Gap 62 on second arm 54 must be less than the width of overmold 46 or casing of male USB 10. Therefore, in order to engage and disengage male USB 10 from shroud 52, male USB 10 must be turned in a vertical disposition. Once male USB 10 is engaged with shroud 52 it can be moved to a horizontal disposition, such that it is in the proper orientation to engage a corresponding female receptor on an electronic device.

Once male USB 10 is engaged with shroud 52, first arm 54 mechanically attaches to an electronic device 64 by engaging adhesive side 58 with electronic device. Adhesive may be any mechanical means of attaching shroud 52 with an electronic device as known in the art at the time the invention was made. In a preferred embodiment, shroud 52 is made of a plastic material. In an alternative embodiment, shroud 52 includes a plurality of notches 66 on supporting side 58. Notches 66 are used to easily adjust size of first arm 54 by removing sections of first arm 52 along the plurality of notches.

FIG. 6 is an illustration of shroud 52 engaged with a mobile electronic device 64 in accordance with a preferred embodiment of the present invention. Overmold 46 has been placed through gap 62. First arm 54 extends along the bottom of the electronic device 64. A plurality of notches 66 allow for adjustment of first arm 54. Second arm extends along the side of the mobile device 64 for support. As shown, electronic device 64 engages with adhesive side 58 of first arm 54 to create a secure hold.

Additionally, the present invention may include incorporation of a security anchor, similar to those shown in U.S. Pat. No. 5,699,591 to Kane and U.S. Pat. No. 6,285,283 to Rand et al. herein incorporated by reference. The anchor, made of pliable material, includes a disk having a central area and radially extending slots that form wing portions. Each wing portion fans out from the housing on the plug and mold around the plug and electronic device, engaging them and locking the plug in place. The wing portions are moldable and removable to provide the maximum hold with the least amount of interference to the electronic device.

Figure 4:
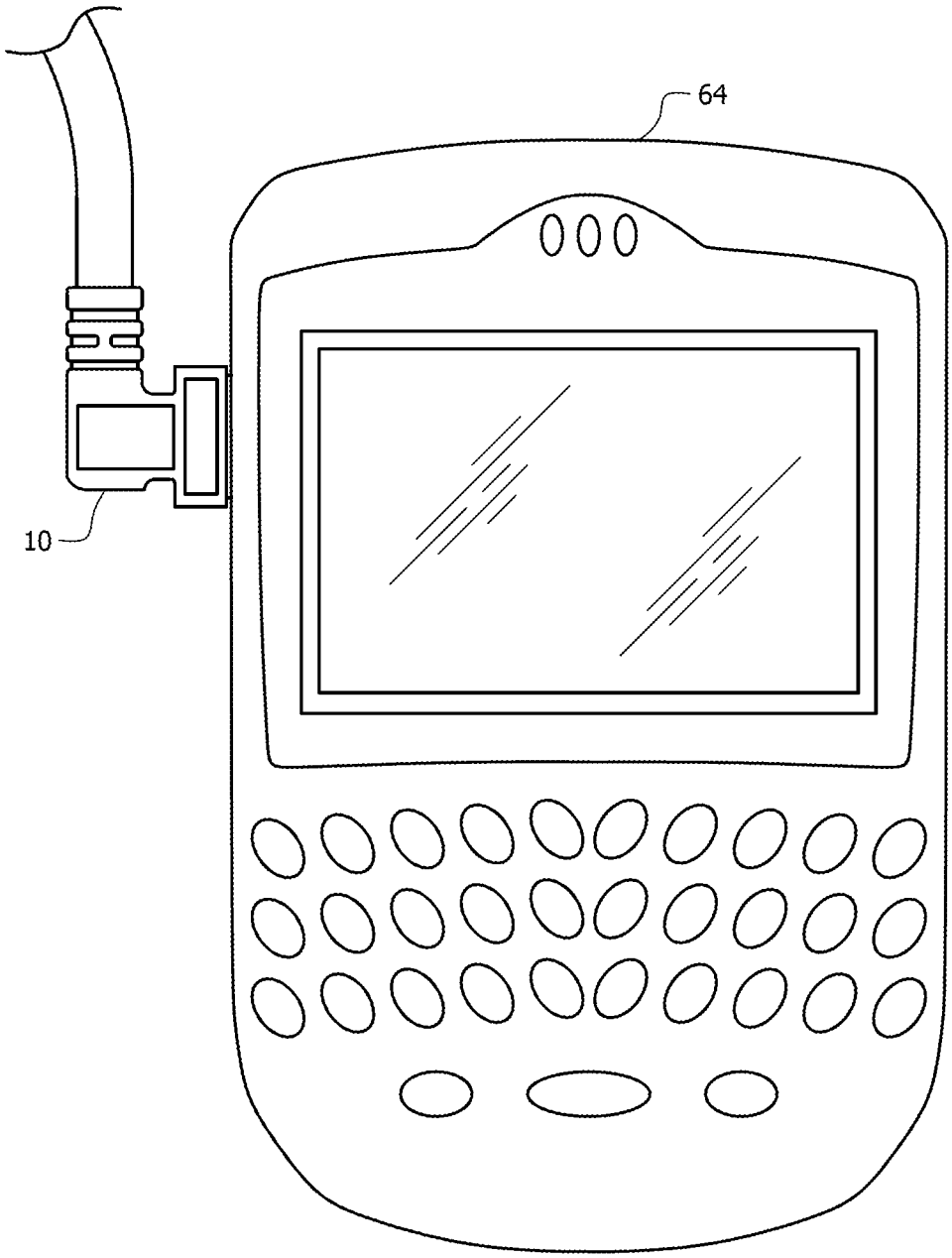
FIG. 4 is an illustration of a preferred embodiment of the present invention engaged with an electronic device.

Creating an alarm system this way has several advantages over the prior art, generally shown in FIG. 4. First, there is a general aesthetic advantage over the prior art. This invention allows the customer full access to an electronic device so that they can view it and hold it in a manner previously unavailable. Second, it allows devices protected through the invention to interact more freely with other devices. This is best illustrated by recent development of near field technology. Near field technology often requires the back of two cellular phones to be in direct or near contact with each other. Prior art security devices substantially blocked the ability of a consumer to try the near field communication. Finally, the present invention significantly changes the functionality of the protection offered in the prior art. Prior art centered on a mechanical engagement to provide security for an electronic device. The present invention provides security through an electronic engagement mechanism through an analog circuit.

The advantages set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

GLOSSARY OF CLAIM TERMS

Analog Electrical Circuit: An electrical circuit whose current or voltage may vary continuously with time to correspond to the information being represented. It is generally constructed from two fundamental blocks; series and parallel circuits. Series circuits have the same current pass through a series of components. Parallel circuits occur when the current divides between various components according to their resistance.

Base end: representative of the portion of a male USB that does not engage with a corresponding female receptor. It is often the portion that protrudes outside when the male USB is engaged with an electronic device.

Contact end: representative of the portion of a male USB that engages a corresponding female receptor. It is the end of the male USB that communicates with electronic device.

Conductor: material which contains movable electric charges.

Conductive material: a type of material which permits flow of electricity in one or more directions.

Elbow joint: a curved hinge or connection point between two arms or linear lines that extend from the connection point.

Female receptor: Representative of the receptacle that receives the male plug.

Gap: a hole or open space within one or more objects through which material may pass.

Male plug: Representative of the plug portion that mates with a corresponding female receptor.

Mini USB: Contains similar width and approximately half the thickness of standard USB plugs. This enables the micro USB to be used on smaller, portable devices such as cellular phones.

Mouth: a portion of a shell located on the base end of a male plug.

Non-conductive material: Also referred to as insulators. It is material with few mobile charges and which support only insignificant electric currents.

Notches: an indentation or recess within a solid material or object.

Shell: An outer covering or structural piece of material. Generally comprised of hard material but may include softer substances.

Shroud: protective object or material. An object used to secure a male plug to an electronic device when the plug is in communication with the electronic device.

Solder point: a location where two pieces are joined together. Generally used to describe the point where a conductor wire is attached to conductive material.

Tongue: a portion of a shell that extends from base end of a male plug into the contact end of the male plug.

USB: stands for Universal Serial Bus. It defines the cables, connectors and communication protocols used in a bus. It can be used for connection, communication and power supply between computers and electronic devices. The USB has replaced earlier interfaces, such as serial port, parallel ports, and power chargers for portable devices.

Wing portion: a portion of a shell of male USB that connects the contact end with the base end.

What is claimed is:

1. An apparatus for an analog electrical circuit that will detect disengagement, comprising:

a male USB (Universal Serial Bus) plug;

said male USB plug including a first shell;

said male USB plug having a contact end and a base end wherein said contact end engages a corresponding female USB receptor;

a second shell in contact with said first shell, wherein said second shell is located on said contact end of said male USB;

a first conductor wire communicating electronically with a first solder point on said second shell;

a third shell in contact with said first shell, wherein said third shell includes a tongue and a mouth;

wherein said mouth is located on said base end and said tongue extending linearly from said mouth through said contact end;

a second conductor wire communicating electronically with a second solder point on said mouth;

wherein said second shell and said third shell are made of conductive material;

wherein said first shell includes non-conductive material.

2. An apparatus for an analog electrical circuit that will detect disengagement as in claim 1, wherein said second shell further comprises:

a wing portion extending from said second shell located on said contact end to said base end, wherein said wing portion has said first solder point for contact of said first conductor wire.

3. An apparatus for an analog electrical circuit that will detect disengagement as in claim 1, wherein said non-conductive material is plastic.

4. An apparatus for an analog electrical circuit that will detect disengagement as in claim 1, wherein said conductive material is metal.

5. An apparatus for an analog electrical circuit that will detect disengagement as in claim 1, wherein said male USB is a micro USB.

6. An apparatus for an analog electrical circuit that will detect disengagement as in claim 1, wherein said tongue extends upwards at a predetermined length from said mouth, forming a hinge portion where said mouth contacts said tongue.

7. An apparatus for an analog electrical circuit that will detect disengagement as in claim 1, further comprising:

a shroud comprising:

a first arm and a second arm being disposed in perpendicular relation to one another connected by an elbow joint;

said second arm including an adhesive side and a base side;

said adhesive side including a mechanism for attaching said second arm to an electronic device;

said first arm and said second arm further including a gap formed within said second arm extending through said elbow joint and into said first arm;

wherein said gap is for engagement of said male USB.

8. A shroud as in claim 7, further comprising a plurality of notches on said base side.

* * * * *